US011892179B2

(12) United States Patent
Feng

(10) Patent No.: US 11,892,179 B2
(45) Date of Patent: Feb. 6, 2024

(54) AIR CONDITIONER OUTDOOR DEVICE AND ISOLATION STRUCTURE THEREOF, AND AIR CONDITIONER

(71) Applicant: FOSHAN SHUNDE MIDEA ELECTRIC SCIENCE AND TECHNOLOGY CO., LTD., Foshan (CN)

(72) Inventor: Jinping Feng, Foshan (CN)

(73) Assignee: FOSHAN SHUNDE MIDEA ELECTRIC SCIENCE AND TECHNOLOGY CO., LTD., Foshan (CN)

( * ) Notice: Subject to any disclaimer, the term of this patent is extended or adjusted under 35 U.S.C. 154(b) by 241 days.

(21) Appl. No.: 17/429,425

(22) PCT Filed: May 24, 2019

(86) PCT No.: PCT/CN2019/088254
§ 371 (c)(1),
(2) Date: Aug. 9, 2021

(87) PCT Pub. No.: WO2020/173006
PCT Pub. Date: Sep. 3, 2020

(65) Prior Publication Data

US 2022/0128246 A1 Apr. 28, 2022

(30) Foreign Application Priority Data

Feb. 27, 2019 (CN) ..... 201920246667.8

(51) Int. Cl.
*F24F 1/40* (2011.01)
*F24F 13/24* (2006.01)
*F24F 13/32* (2006.01)

(52) U.S. Cl.
CPC ..... *F24F 1/40* (2013.01); *F24F 13/24* (2013.01); *F24F 13/32* (2013.01)

(58) Field of Classification Search
CPC ..... F24F 1/40
(Continued)

(56) References Cited

U.S. PATENT DOCUMENTS 4,067,525 A * 1/1978 Allen ..... F16F 1/3732 248/632
4,718,631 A * 1/1988 Reynolds ..... F16F 3/093 206/592

(Continued)

FOREIGN PATENT DOCUMENTS

CN 202581605 U 12/2012
CN 203163198 U 8/2013

(Continued)

OTHER PUBLICATIONS

World Intellectual Property Organization (WIPO) International Search Report and Written opinion for PCT/CN2019/088254 dated Nov. 27, 2019 14 Pages (Translation Included).

*Primary Examiner* — Anita M King
(74) *Attorney, Agent, or Firm* — Anova Law Group, PLLC

(57) ABSTRACT

An air conditioner outdoor device isolation structure includes a foot and a vibration isolation member. The foot includes a mounting hole. The vibration isolation member includes a first end part, a connection part, and a second end part connected in sequence, and a connection hole penetrating the first end part, the connection part, and the second end part. The connection part is located in the mounting hole, and the first end part and the second end part are located on opposite sides of the mounting hole.

16 Claims, 19 Drawing Sheets

(58) Field of Classification Search
USPC ..... 248/672
See application file for complete search history.

(56) References Cited

U.S. PATENT DOCUMENTS

| | | | | |
|---|---|---|---|---|
| 7,070,157 | B2 * | 7/2006 | Huprikar | F16F 1/37 248/560 |
| 7,744,050 | B2 * | 6/2010 | de Toledo | F16M 7/00 248/650 |
| 2007/0267561 | A1 * | 11/2007 | Dam | A47B 91/024 248/615 |

FOREIGN PATENT DOCUMENTS

| | | | |
|---|---|---|---|
| CN | 204806564 | U | 11/2015 |
| CN | 205446534 | U | 8/2016 |
| CN | 207162779 | U | 3/2018 |
| CN | 207584948 | U | 7/2018 |
| JP | H09250781 | A | 9/1997 |
| JP | 2000134862 | A | 5/2000 |

* cited by examiner

AIR CONDITIONER OUTDOOR DEVICE AND ISOLATION STRUCTURE THEREOF, AND AIR CONDITIONER

CROSS-REFERENCE TO RELATED APPLICATIONS

The present application is a National Stage Entry under 35 U.S.C. § 371 of International Application No. PCT/CN2019/088254, filed on May 24, 2019, which claims priority to Chinese Patent Application No. 2019202466678, filed with the China Patent Office on Feb. 27, 2019 and entitled "AIR CONDITIONER OUTDOOR DEVICE AND ISOLATION STRUCTURE THEREOF, AND AIR CONDITIONER," the entire contents of both of which are herein incorporated by reference.

FIELD

The present disclosure relates to the technical field of air conditioners, and more specifically, to an air conditioner outdoor device isolation structure, an air conditioner outdoor device including the air conditioner outdoor device isolation structure, and an air conditioner including the air conditioner outdoor device.

BACKGROUND

At present, the outdoor device foot is very rigid, lacks elasticity, and does not have the ability to isolate vibration, which will cause the vibration of the outdoor device to be transmitted to the installation foundation, which in turn stimulates the vibration of the wall, causing noise complaints.

Some outdoor device feet in related technologies have vibration isolation measures, but the structure is rough and simple, and there are many problems in the installation process. The vibration isolation member of the outdoor device is also installed at the outdoor device foot. The assembly relationship between the outdoor device foot and the vibration isolation member is similar to the "wearing shoes" method. The foot needs to be inserted inside the vibration isolation member. Because the foot is more complex, this structure is basically difficult to achieve in the actual operation process, the installation process is very difficult, and many materials are used and the cost is high.

SUMMARY

The present disclosure aims to solve at least one of the technical problems in the existing technologies.

For this reason, the first aspect of the present disclosure aims to provide an air conditioner outdoor device isolation structure.

The second aspect of the present disclosure aims to provide an air conditioner outdoor device including the above-mentioned isolation structure.

The third aspect of the present disclosure aims to provide an air conditioner including the above-mentioned air conditioner outdoor device.

In order to achieve the above purpose, the embodiments of the first aspect of the present disclosure provide an air conditioner outdoor device isolation structure, comprising: a foot, being provided with a mounting hole; and a vibration isolation member, including a first end part, a connection part and a second end part connected in sequence, wherein the connection part is located in the mounting hole, the first end part and the second end part are located on opposite sides of the mounting hole, and the vibration isolation member is provided with a connection hole penetrating the first end part, the connection part and the second end part.

In the isolation structure provided by the above-mentioned embodiment, the fastener passes through the connection hole, and the foot is fixed at the installation foundation. The first end part can effectively separate the fastener and the foot, avoiding the transmission of vibration to the fastener through the foot, thereby avoiding the transmission of vibration from the fastener to the installation foundation. The second end part can effectively separate the installation foundation and the outdoor device foot, avoiding the vibration from being directly transmitted to the installation foundation through the foot, and effectively isolating the vibration of the outdoor device from being transmitted to the installation foundation. Moreover, the vibration isolation member in the present disclosure does not need to completely wrap the foot, so the vibration isolation member uses less materials and is low in cost, and the vibration isolation member and outdoor device foot are easy to install and more user-friendly.

In addition, the isolation structure provided by the above-mentioned embodiment of the present disclosure also has the following additional technical features.

In one embodiment, the connection hole is used to cooperate with a fastener, and a positioning member is provided in the connection hole, for positioning between the fastener and the connection hole.

The installation foundation is provided with an assembly hole, the fastener passes through the connection hole and the assembly hole, and the foot is fixed at the installation foundation. The installation foundation can be an installation bracket, the installation bracket is fixed at the wall, or the installation foundation is directly an installation platform such as a wall.

The positioning member ensures that the installation fastener passes through the vibration isolation member near the center position of the connection hole, to avoid excessive deviation between the center of the fastener and the center of the connection hole, resulting in a reduction in the vibration isolation effect. The fastener can be but not limited to screws or bolts.

In one embodiment, the positioning member includes a positioning protrusion formed protrudingly by an inner wall of the connection hole facing in a direction close to an axis of the connection hole.

The positioning member includes a positioning protrusion formed by the inner wall of the connection hole protruding inward. After setting the positioning protrusion, the opening size of the connection hole at the positioning protrusion becomes smaller, so as to minimize the deviation between the center of the fastener and the center of the connection hole as much as possible. In one embodiment, the inner wall surface of the positioning member protrudes inwardly along its circumferential direction to form annular positioning protrusions, or the number of positioning protrusions is multiple. Multiple positioning protrusions are arranged at intervals along the circumferential direction of the connection hole, and multiple positioning protrusions can reduce the offset range of the fastener in the connection hole.

In one embodiment, the second end part is suitable to be arranged between the foot and an installation foundation, and the connection hole includes a first hole section and a second hole section that are in communication with each other, along a direction from the first end part to the second end part, the first hole section and the second hole section are arranged in sequence, and the second hole section penetrates an end surface of the second end part away from the first end part, and the opening size of the second hole section is larger than the opening size of the first hole section.

The opening size of the second hole section is larger than the opening size of the first hole section. When the first hole section is misaligned with the assembly hole, the fastener can move in the second hole section, that is, the second hole section has the ability to accommodate the misalignment between the vibration isolation member and the installation foundation.

In one embodiment, the first end part is located above the second end part, the first hole section is located above the second hole section, and the second hole section penetrates the lower end surface of the second end part.

In one embodiment, the foot is provided with an avoidance member for avoiding the vibration isolation member or the vibration isolation member is provided with an avoidance member for avoiding the foot, so that the vibration isolation member and the foot can deviate from an axis of the mounting hole and move relative to each other.

Exemplarily, the second end part is suitable to be set between the foot and an installation foundation. The foot is provided with an avoidance member for avoiding the second end part or the second end part is provided with an avoidance member for avoiding the foot. Thereby the second end part and the foot can deviate from the axis of the mounting hole to move relative to each other.

The avoidance member can be an avoidance hole or an avoidance gap. After setting the avoidance member, the second end part can move relative to the foot in the direction deviating from the axis of the mounting hole or the axis of the connection hole. For example, the second end part can be moved left and right or back and forth relative to the foot, to solve the alignment problem between the connection hole of the vibration isolation member and the assembly hole of the installation foundation during installation, so that the connection hole and the assembly hole are easier to align, thereby improving the previous assembly efficiency of the foot, the vibration isolation member and the installation foundation.

In one embodiment, a rotation limit member is provided at the vibration isolation member, and a rotation limit mating member is provided at the foot, to limit a relative rotation between the vibration isolation member and the foot, the positioning between the foot and the vibration isolation member is realized, and the rotation of the vibration isolation member relative to the foot is avoided.

In one embodiment, the rotation limit member includes a first limit protrusion arranged at the vibration isolation member, and the first limit protrusion interferes with the rotation limit mating member and can rotate relatively.

Exemplarily, the second end part is suitable to be set between the foot and an installation foundation, the rotation limit member includes the first limit protrusion set on the second end part, and the first limit protrusion and the rotation limit mating member interfere with each other and can rotate relative to each other.

When the first end part passes through the mounting hole and is installed above the mounting hole, rotate the vibration isolation member relative to the foot by a predetermined angle. During the rotation, the first limit protrusion interferes with the rotation limit mating member, but when the rotation force on the vibration isolation member is increased, the first limit protrusion can continue to rotate across the rotation limit mating member, after crossing, the required rotation force is reduced. At this time, there is obvious hand feeling feedback, and users can feel that the vibration isolation member is rotated in place relative to the foot. On the one hand, it is easy to feel when the vibration isolation member is rotated in place. Thereby, the assembly efficiency between the vibration isolation member and the foot can be improved, and on the other hand, the assembly accuracy between the vibration isolation member and the foot can be improved.

In one embodiment, the rotation limit member also includes a second limit protrusion arranged at the vibration isolation member, a limit groove is formed between the second limit protrusion and the first limit protrusion, and the rotation limit mating member can be confined within the limit groove.

When the vibration isolation member is rotated in place relative to the foot, the rotation limit mating member is located in the limit groove, thereby preventing the vibration isolation member from rotating randomly around the axis of the connection hole.

In one embodiment, the foot is provided with a receiving hole, the second end part is at least partially located in the receiving hole; the rotation limit mating member includes a hole wall of the receiving hole, and the rotation limit member is arranged at the second end part.

In one embodiment, the vibration isolation member includes a main body, the main body is located in the receiving hole, and the rotation limit member is set on the main body and corresponds to the rotation limit mating member. In order to facilitate the insertion of the second end part into the receiving hole, the receiving hole is opened downward. For example, the rotation limit member is set on the left side of the main body, and the rotation limit mating member includes the left side wall of the receiving hole. Further, there are multiple rotation limit members, and multiple rotation limit members are set along the circumferential direction of the second end part. For example, one rotation limit member is set on the left side of the main body, and the other rotation limit member is set on the right side of the main body.

In one embodiment, the second end part includes a main body and a side edge connected to a side of the main body, the connection hole penetrates the main body, and the thickness of the main body is greater than the thickness of the side edge.

The main elastic bearing structure is concentrated in the second end part, especially the main body part of the second end part, in order to enhance the elastic bearing capacity of the main body part; the main body part is the thickest part. The side edge can be connected to the left and/or right side of the main body, to reduce the material of the side edge. In one embodiment, the upper and/or lower end surface of the side edge is thinned, to avoid that after the vibration isolation member is deformed due to the load, the vibration of the foot is transmitted to the installation foundation through the side edge, resulting in a relatively weakened vibration isolation effect, which can ensure the best vibration isolation effect.

In one embodiment, the mounting hole is non-circular, the first end part can pass through the mounting hole, and after the first end part and the mounting hole are relatively rotated by a predetermined angle, the first end part interferes with the mounting hole in a direction from the first end part to the second end part; or the mounting hole is non-circular, the second end part can pass through the mounting hole, and after the second end part and the mounting hole are relatively rotated by a predetermined angle, the second end part interferes with the mounting hole in a direction from the second end part to the first end part.

The first end part passes through the mounting hole in a direction from the second end part to the first end part (bottom-up), and is located above the mounting hole. The vibration isolation member rotates by a predetermined angle relative to the foot, so that the vibration isolation member rotates in place relative to the foot. In the process of rotating by the predetermined angle, the first end part interferes with the foot in a downward direction, so as to prevent the first end part from falling out of the mounting hole and facilitate the rotation of the vibration isolation member. The mounting hole can also be a waist-shaped hole, and the shape and size of the first end part are adapted to the shape and size of the mounting hole, respectively.

Or, the second end part passes through the mounting hole in a direction from the first end part to the second end part (bottom-up), and is located above the mounting hole. The vibration isolation member rotates by a predetermined angle relative to the foot, so that the vibration isolation member rotates in place relative to the foot. In the process of rotating by the predetermined angle, the second end part interferes with the foot in a downward direction, so as to prevent the second end part from falling out of the mounting hole and facilitate the rotation of the vibration isolation member. The mounting hole can also be a waist-shaped hole, and the shape and size of the second end part are adapted to the shape and size of the mounting hole, respectively.

In one embodiment, a positioning groove is provided at the connection part, and the positioning groove is located in the mounting hole.

The connection part is provided with a positioning groove, and the cross-sectional size of the first end part and the second end part is larger than the cross-sectional size of the positioning groove provided at the connection part. Thereby a neck is formed at the positioning groove, so that the foot cannot move up or down from the connection part and the foot is tightly pressed between the first end part and the second end part.

In one embodiment, the vibration isolation member is an elastic part, for example, the vibration isolation member is rubber vibration isolation member, silicone vibration isolation member or foam vibration isolation member.

In one embodiment, the vibration isolation member is provided with a rigidity weakening hole, the rigidity weakening hole can reduce the rigidity of the vibration isolation member, and further reduce the transmission of the vibration of the outdoor device to the installation foundation.

In one embodiment, at least one of the first end part and the second end part is provided with a vibration isolation groove, thereby forming a vibration damping rib, to further improve the vibration isolation ability. The vibration isolation groove can be in multiple directions, such as a vertical and horizontal vibration isolation groove. Further, the lower end of the second end part is provided with a vibration isolation groove.

The embodiments of the second aspect of the present disclosure provide an air conditioner outdoor device, which includes an outdoor device main body, and also includes the air conditioner outdoor device isolation structure as described in any one of the embodiments of the first aspect. The foot of the isolation structure is connected to the outdoor device main body.

The air conditioner outdoor device provided by the embodiments of the second aspect of the present disclosure includes the isolation structure described in any one of the embodiments of the first aspect, and therefore it has all the beneficial effects of the isolation structure described in any one of the embodiments of the first aspect, which will not be repeated here.

In one embodiment, the outdoor device main body includes a chassis, and the foot is connected to the chassis. For example, the foot is welded to the chassis. The number of the foot is multiple, for example, the number of the foot is 2.

The embodiments of the third aspect of the present disclosure provide an air conditioner, which includes an indoor device, and further includes the air conditioner outdoor device as described in the above-mentioned embodiment and the air conditioner outdoor device is connected to the indoor device.

The air conditioner provided by the embodiments of the third aspect of the present disclosure includes the air conditioner outdoor device described in the embodiments of the second aspect, and therefore it has all the beneficial effects of the air conditioner outdoor device described in the embodiments of the second aspect, which will not be repeated here.

Additional aspects and advantages of the present disclosure will become apparent in the following description, or are understood by the practice of the present disclosure.

BRIEF DESCRIPTION OF THE DRAWINGS

The above and/or additional aspects and advantages of the present disclosure will become apparent and readily understood from the description of embodiments in conjunction with the following drawings.

Figure 1:
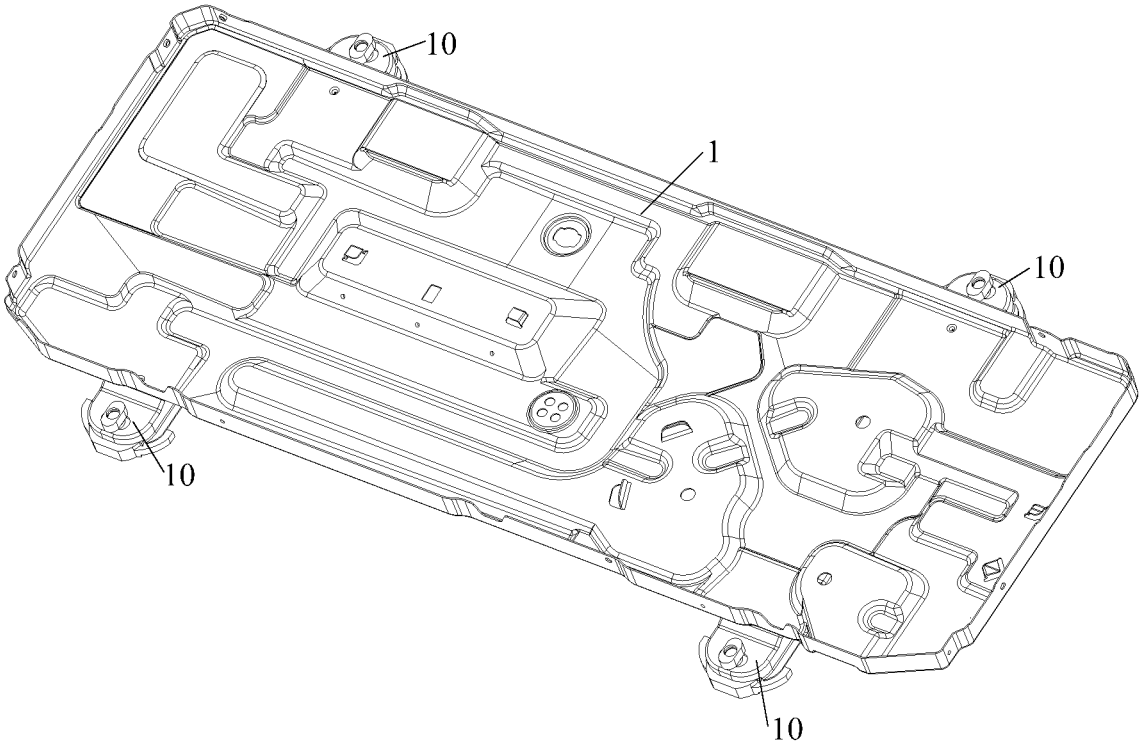
FIG. 1 is a schematic structural diagram of the assembly of the chassis and the isolation structure described in Embodiment 1 of the present disclosure.
Figure 2:
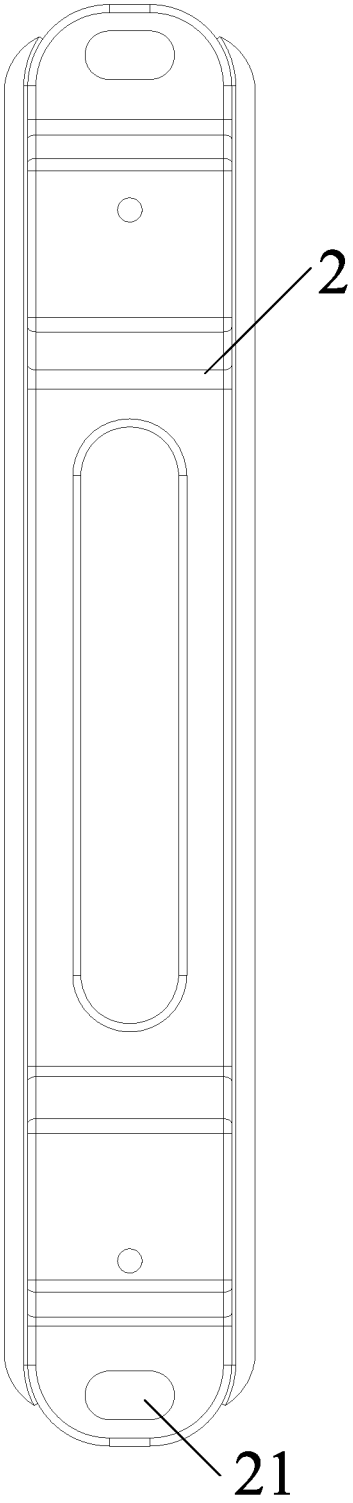
FIG. 2 is a schematic structural diagram from the first view of the foot described in Embodiment 1 of the present disclosure.
Figure 3:
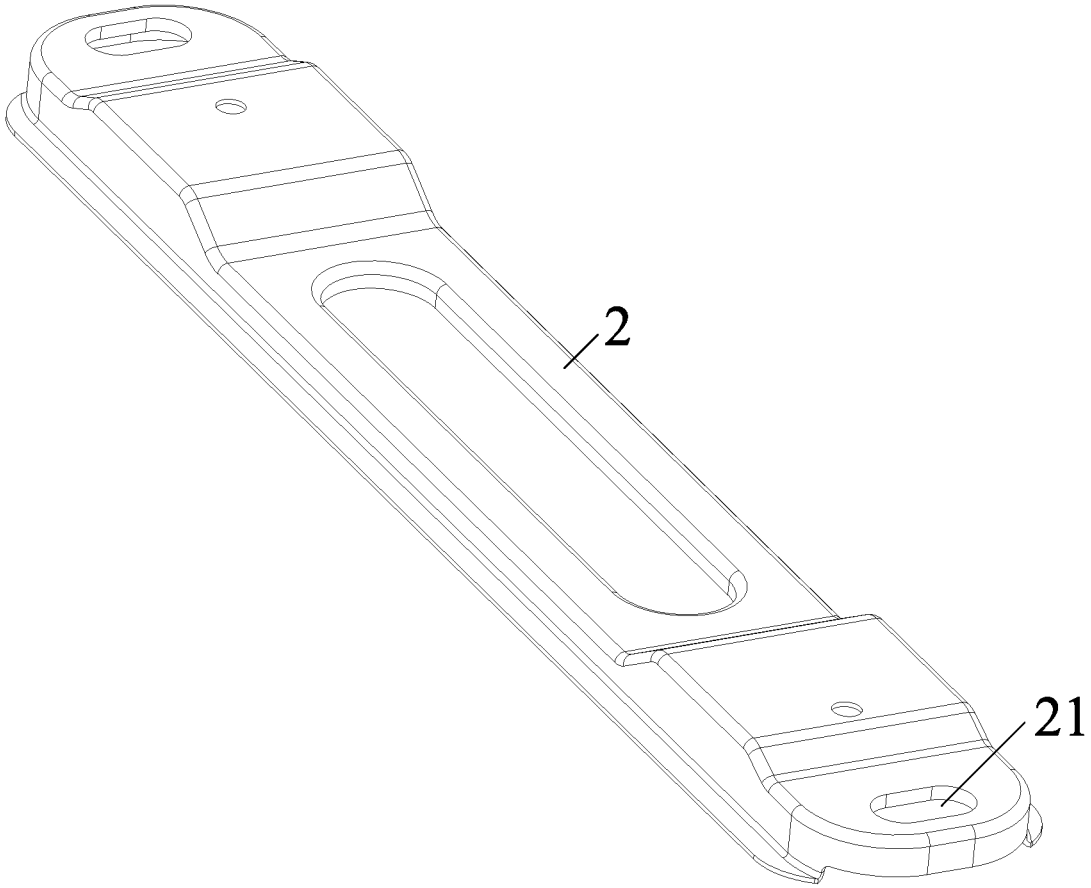
FIG. 3 is a schematic structural diagram from the second view of the foot described in Embodiment 1 of the present disclosure.

Wherein, the correspondence between the reference numerals and component names in FIGS. 1 to 20 is:

1 chassis, 2 foot, 21 mounting hole, 3 vibration isolation member, 31 first end part, 32 second end part, 321 first limit protrusion, 322 second limit protrusion, 323 limit groove, 324 main body, 325 side edge, 33 connection part, 331 positioning groove, 34 vibration isolation groove, 35 connection hole, 351 first hole section, 352 second hole section, 353 positioning protrusion, 36 vibration damping rib, 10 isolation structure.

DETAILED DESCRIPTION OF THE DISCLOSURE

In order that the above-mentioned objectives, features and advantages of the present disclosure can be understood more clearly, a further detailed description of the present disclosure will be given below in connection with the accompanying drawings and specific embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure can also be implemented in other manners than those described herein. Therefore, the protection scope of the present disclosure is not limited to the specific embodiments disclosed below.

An air conditioner outdoor device and its isolation structure, an air conditioner according to some embodiments of the present disclosure are described below with reference to attached FIGS. 1 to 20.

As shown in FIG. 1, according to some embodiments of the present disclosure, an isolation structure 10 of an outdoor device is provided, which includes a foot 2 and a vibration isolation member 3. The foot 2 is provided with a mounting hole 21; and the vibration isolation member 3 includes a first end part 31, a connection part 33 and a second end part 32 connected in sequence, wherein the connection part 33 is located in the mounting hole 21, the first end part 31 and the second end part 32 are located on opposite sides of the mounting hole 21, and the vibration isolation member 3 is provided with a connection hole 35 penetrating the first end part 31, the connection part 33 and the second end part 32.

In the isolation structure 10 of the outdoor device provided by the above-mentioned embodiment, the fastener passes through the connection hole 35, and the foot 2 is fixed at the installation foundation. The first end part 31 can effectively separate the fastener and the foot 2, avoiding the transmission of vibration to the fastener through the foot 2, thereby avoiding the transmission of vibration from the fastener to the installation foundation. The second end part 32 can effectively separate the installation foundation and the outdoor device foot 2, avoiding the vibration from being directly transmitted to the installation foundation through the foot 2, and effectively isolating the vibration of the outdoor device from being transmitted to the installation foundation. Moreover, the vibration isolation member 3 in the present disclosure does not need to completely wrap the foot 2, so the vibration isolation member 3 uses less materials and is low in cost, and the vibration isolation member 3 and outdoor device foot 2 are easy to install and more user-friendly.

Embodiment 1

An isolation structure 10 of the outdoor device includes a foot 2 and a vibration isolation member 3. The foot 2 is provided with a mounting hole 21; and the vibration isolation member 3 includes a first end part 31, a connection part 33 and a second end part 32 connected in sequence, wherein the connection part 33 is located in the mounting hole 21, the first end part 31 and the second end part 32 are located on opposite sides of the mounting hole 21, and the vibration isolation member 3 is provided with a connection hole 35 penetrating the first end part 31, the connection part 33 and the second end part 32.

In one embodiment, the connection hole 35 is used to cooperate with a fastener, and a positioning member is provided in the connection hole 35, for positioning between the fastener and the connection hole 35.

The second end part 32 is located below the first end part 31, and the second end part 32 is set between the installation foundation and foot 2. The installation foundation is provided with an assembly hole, the fastener passes through the connection hole 35 and the assembly hole, and the foot 2 is fixed at the installation foundation. The installation foundation can be an installation bracket, the installation bracket is fixed at the wall, or the installation foundation is directly an installation platform such as a wall.

The positioning member ensures that the installation fastener passes through the vibration isolation member 3 near the center position of the connection hole 35, to avoid excessive deviation between the center of the fastener and the center of the connection hole 35, resulting in a reduction in the vibration isolation effect. The fastener can be but not limited to screws or bolts.

In one embodiment, the positioning member includes a positioning protrusion 353 formed protrudingly by an inner wall of the connection hole 35 facing in a direction close to an axis of the connection hole 35.

The positioning member includes a positioning protrusion 353 formed by the inner wall of the connection hole 35 protruding inward. After setting the positioning protrusion 353, the opening size of the connection hole 35 at the positioning protrusion 353 becomes smaller, so as to minimize the deviation between the center of the fastener and the center of the connection hole 35 as much as possible. In one embodiment, the inner wall surface of the positioning member protrudes inwardly along its circumferential direction to form annular positioning protrusions 353, or the number of positioning protrusions 353 is multiple. Multiple positioning protrusions 353 are arranged at intervals along the circumferential direction of the connection hole 35, and multiple positioning protrusions 353 can reduce the offset range of the fastener in the connection hole 35.

In one embodiment, a rotation limit member is provided at the vibration isolation member 3, and a rotation limit mating member is provided at the foot 2, to limit a relative rotation between the vibration isolation member 3 and the foot 2, the positioning between the foot 2 and the vibration isolation member 3 is realized, and the rotation of the vibration isolation member 3 relative to the foot 2 is avoided.

In one embodiment, the second end part 32 is suitable to be set between the foot 2 and the installation foundation, the rotation limit member includes the first limit protrusion 321 set on the second end part 32, and the first limit protrusion 321 and the rotation limit mating member interfere with each other and can rotate relative to each other.

When the first end part 31 passes through the mounting hole 21 and is installed above the mounting hole 21, rotate the vibration isolation member 3 relative to the foot 2 by a predetermined angle. During the rotation, the first limit protrusion 321 interferes with the rotation limit mating member, but when the rotation force on the vibration isolation member 3 is increased, the first limit protrusion 321 can continue to rotate across the rotation limit mating member, after crossing, the required rotation force is reduced. At this time, there is obvious hand feeling feedback, and users can feel that the vibration isolation member 3 is rotated in place relative to the foot 2. On the one hand, it is easy to feel when the vibration isolation member 3 is rotated in place. Thereby, the assembly efficiency between the vibration isolation member 3 and the foot 2 can be improved, and on the other hand, the assembly accuracy between the vibration isolation member 3 and the foot 2 can be improved.

In one embodiment, the rotation limit member also includes a second limit protrusion 322, a limit groove 323 is formed between the second limit protrusion 322 and the first limit protrusion 321, and the rotation limit mating member can be confined within the limit groove 323.

When the vibration isolation member 3 is rotated in place relative to the foot 2, the rotation limit mating member is located in the limit groove 323, thereby preventing the vibration isolation member 3 from rotating randomly around the axis of the connection hole 35.

In one embodiment, the foot 2 is provided with a receiving hole, the second end part 32 is at least partially located in the receiving hole; the rotation limit mating member includes a hole wall of the receiving hole.

In one embodiment, the vibration isolation member 3 includes a main body 324, the main body 324 is located in the receiving hole, and the rotation limit member is set on the main body 324 and corresponds to the rotation limit mating member. In order to facilitate the insertion of the second end part 32 into the receiving hole, the receiving hole is opened downward. For example, the rotation limit member is set on the left side of the main body 324, and the rotation limit mating member includes the left side wall of the receiving hole. Further, there are multiple rotation limit members, and multiple rotation limit members are set along the circumferential direction of the second end part 32. For example, one rotation limit member is set on the left side of the main body 324, and the other rotation limit member is set on the right side of the main body 324.

In one embodiment, the second end part 32 is suitable to be arranged between the foot 2 and the installation foundation, and the connection hole 35 includes a first hole section 351 and a second hole section 352 that are in communication with each other, along a direction from the first end part 31 to the second end part 32, the first hole section 351 and the second hole section 352 are arranged in sequence, and the second hole section 352 penetrates an end surface of the second end part 32 away from the first end part 31, and the opening size of the second hole section 352 is larger than the opening size of the first hole section 351.

The opening size of the second hole section 352 is larger than the opening size of the first hole section 351. When the first hole section 351 is misaligned with the assembly hole, the fastener can move in the second hole section 352, that is, the second hole section 352 has the ability to accommodate the misalignment between the vibration isolation member 3 and the installation foundation.

In one embodiment, the first end part 31 is located above the second end part 32, the first hole section 351 is located above the second hole section 352, and the second hole section 352 penetrates the lower end surface of the second end part 32.

In one embodiment, the second end part 32 includes a main body 324 and a side edge 325 connected to the side surface of the main body 324. The connection hole 35 penetrates the main body 324, and the thickness T2 of the main body 324 is greater than the thickness T1 of the side edge 325.

The main elastic bearing structure is concentrated in the second end part 32, especially the main body part 324 of the second end part 32, in order to enhance the elastic bearing capacity of the main body part 324; the main body part 324 is the thickest part. The side edge 325 can be connected to the left and/or right side of the main body 324, to reduce the material of the side edge 325. In one embodiment, the upper and/or lower end surface of the side edge 325 is thinned, to avoid that after the vibration isolation member 3 is deformed due to the load, the vibration of the foot 2 is transmitted to the installation foundation through the side edge 325, resulting in a relatively weakened vibration isolation effect, which can ensure the best vibration isolation effect.

In one embodiment, the mounting hole 21 is non-circular, the first end part 31 can pass through the mounting hole 21, and after the first end part 31 and the mounting hole 21 are relatively rotated by a predetermined angle, the first end part 31 interferes with the mounting hole 21 in a direction from the first end part 31 to the second end part 32.

The mounting hole 21 is a non-circular hole, so that the mounting hole 21 has at least two different opening sizes, so that the first end part 31 can pass through the mounting hole 21, and after the first end part 31 passes through the mounting hole 21, and it rotates by a predetermined angle relative to the mounting hole 21, the first end part 31 will interfere with the mounting hole 21 in a direction from the first end part 31 to the second end part 32, to prevent the first end part 31 from falling out of the mounting hole 21. The first end part 31 passes through the mounting hole 21 in a direction from the second end part 32 to the first end part 31 (bottom-up), and is located above the mounting hole 21. The vibration isolation member 3 rotates by a predetermined angle relative to the foot 2, so that the vibration isolation member 3 rotates in place relative to the foot 2. In the process of rotating by the predetermined angle, the first end part 31 interferes with the foot 2 in a downward direction, so as to prevent the first end part 31 from falling out of the mounting hole 21 and facilitate the rotation of the vibration isolation member 3.

For example, the mounting hole 21 can also be a waist-shaped hole, and the shape and size of the first end part 31 are adapted to the shape and size of the mounting hole 21, respectively. After the first end part 31 passes through the mounting hole 21, it rotates by a predetermined angle relative to the mounting hole 21, such as 90°. The first end part 31 and the mounting hole 21 interfere in a direction from the first end part 31 to the second end part 32.

In one embodiment, a positioning groove 331 is provided at the connection part 33, and the positioning groove 331 is located in the mounting hole 21.

The connection part 33 is provided with a positioning groove 331, and the cross-sectional size of the first end part 31 and the second end part 32 is larger than the cross-sectional size of the positioning groove 331 provided at the connection part 33. Thereby a neck is formed at the positioning groove 331, so that the foot 2 cannot move up or down from the connection part 33 and the foot 2 is tightly pressed between the first end part 31 and the second end part 32.

Exemplary: the foot 2 is welded to the chassis 1 to support the main body of the outdoor device. The vibration isolation member 3 is installed at the mounting hole 21 of the foot 2, and the vibration isolation member 3 is elastic and can be made of rubber or foam. The vibration isolation member 3 passes through the first end part 31, the second end part 32 and the connection part 33, so that the vibration isolation member 3 clamps the mounting hole 21 of the outdoor device foot 2 tightly, and acts as a fixed constraint. The first end part 31 can effectively separate the fastener (such as bolts) and foot 2, to prevent vibration from being transmitted to the bolt through the foot 2, thereby avoiding vibration from being transmitted to the installation foundation through the bolt. The second end part 32 can effectively separate the installation foundation and the outdoor device foot 2, avoiding vibration from being directly transmitted to the installation foundation through the foot 2. The vibration isolation member 3 is provided with a connection hole 35, the connection hole 35 is a through hole, and the connection hole 35 is provided with a positioning protrusion 353 for positioning fastener (such as bolts). This ensures that the mounting bolt passes through the vibration isolation member 3 near the center of the connection hole 35, avoiding excessive deviation between the center of the mounting bolt and the center of the connection hole 35, which will reduce the vibration isolation effect.

Figure 4:
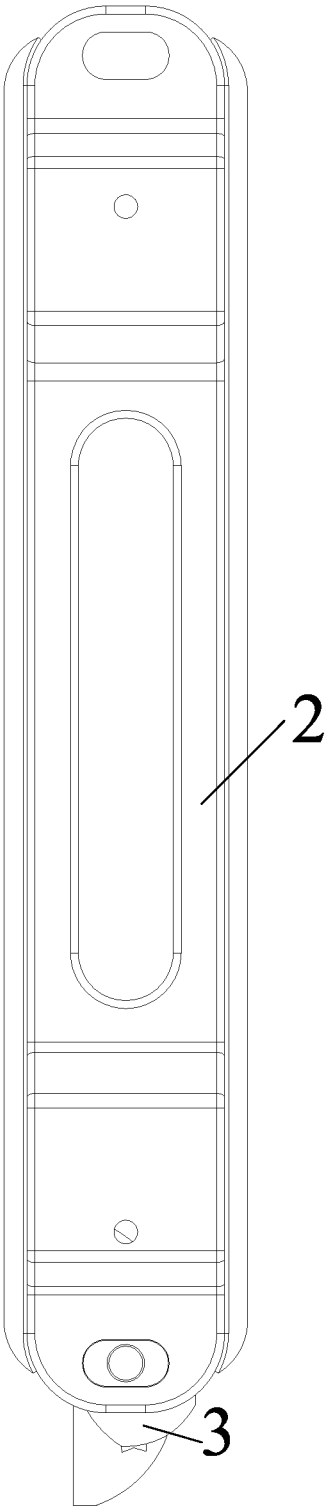
FIG. 4 is a schematic structural diagram from the first view of the isolation structure described in Embodiment 1 of the present disclosure.
Figure 5:
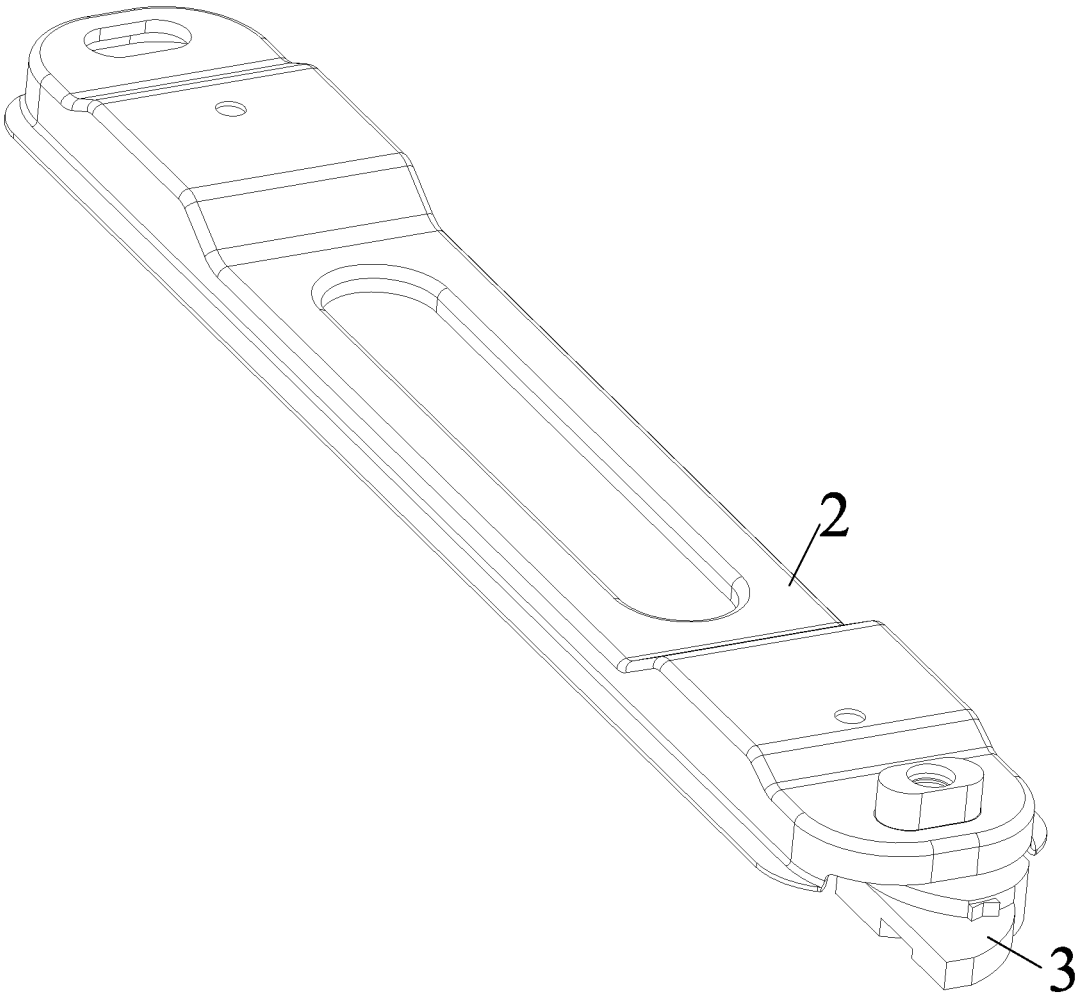
FIG. 5 is a schematic structural diagram from the second view of the isolation structure described in Embodiment 1 of the present disclosure.
Figure 6:
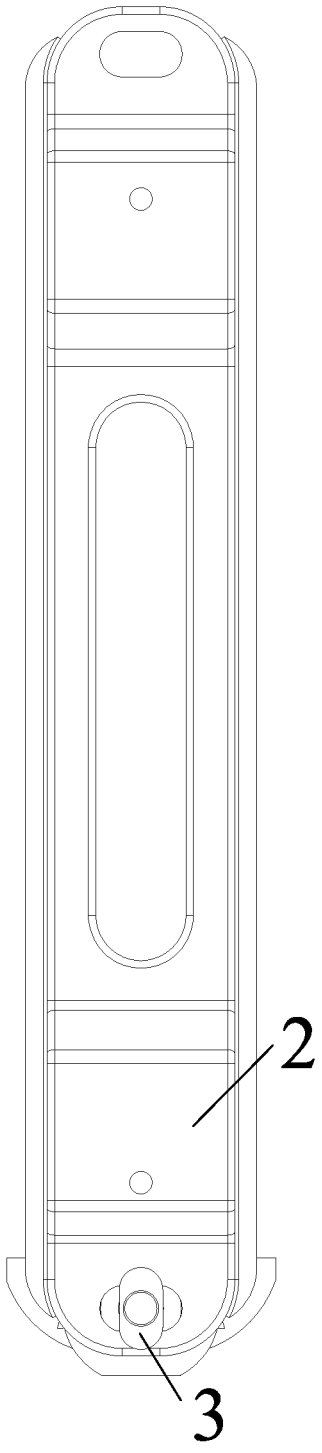
FIG. 6 is a schematic structural diagram of the isolation structure described in Embodiment 1 of the present disclosure from a first perspective.
Figure 7:
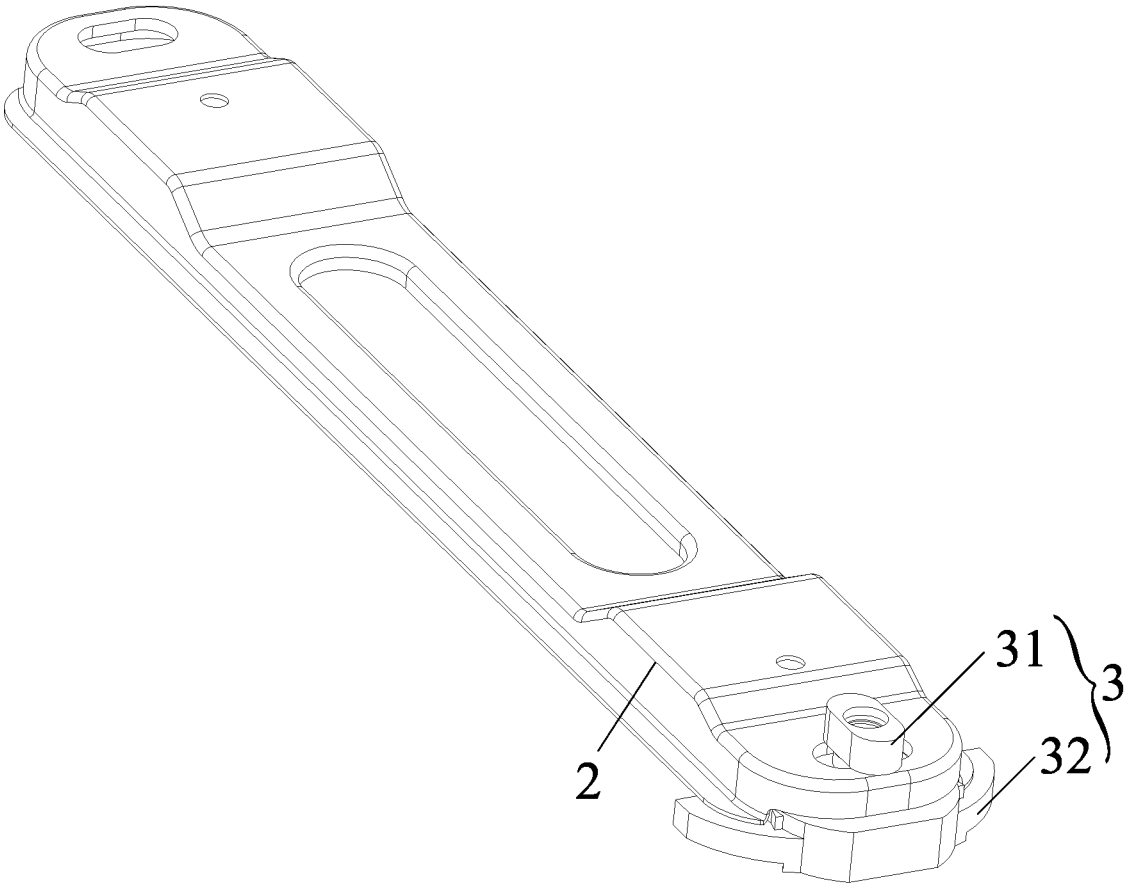
FIG. 7 is a schematic structural diagram of the isolation structure described in Embodiment 1 of the present disclosure from a second perspective.
Figure 8:
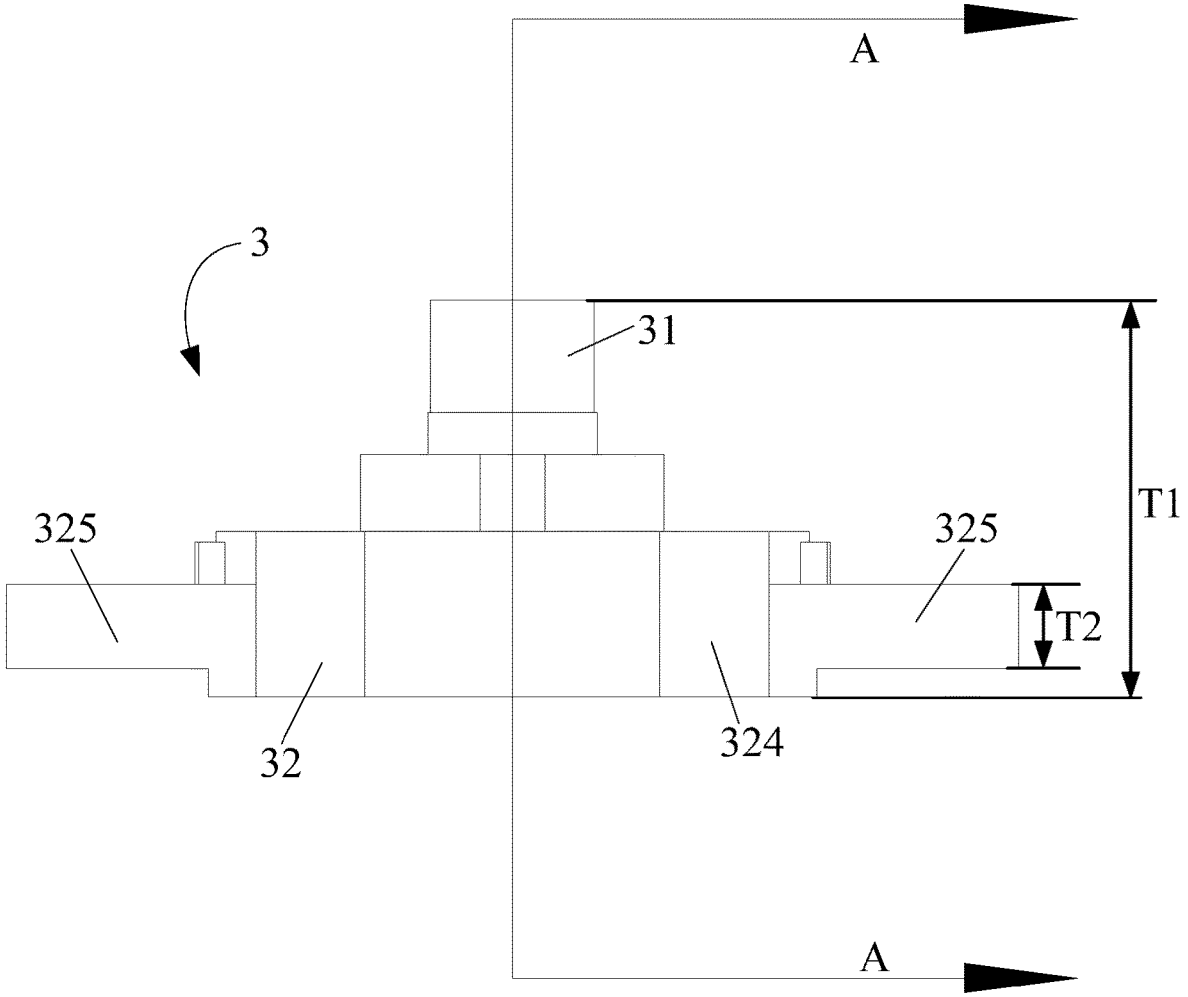
FIG. 8 is a schematic structural diagram of the vibration isolation member described in Embodiment 1 of the present disclosure from a first perspective.
Figure 9:
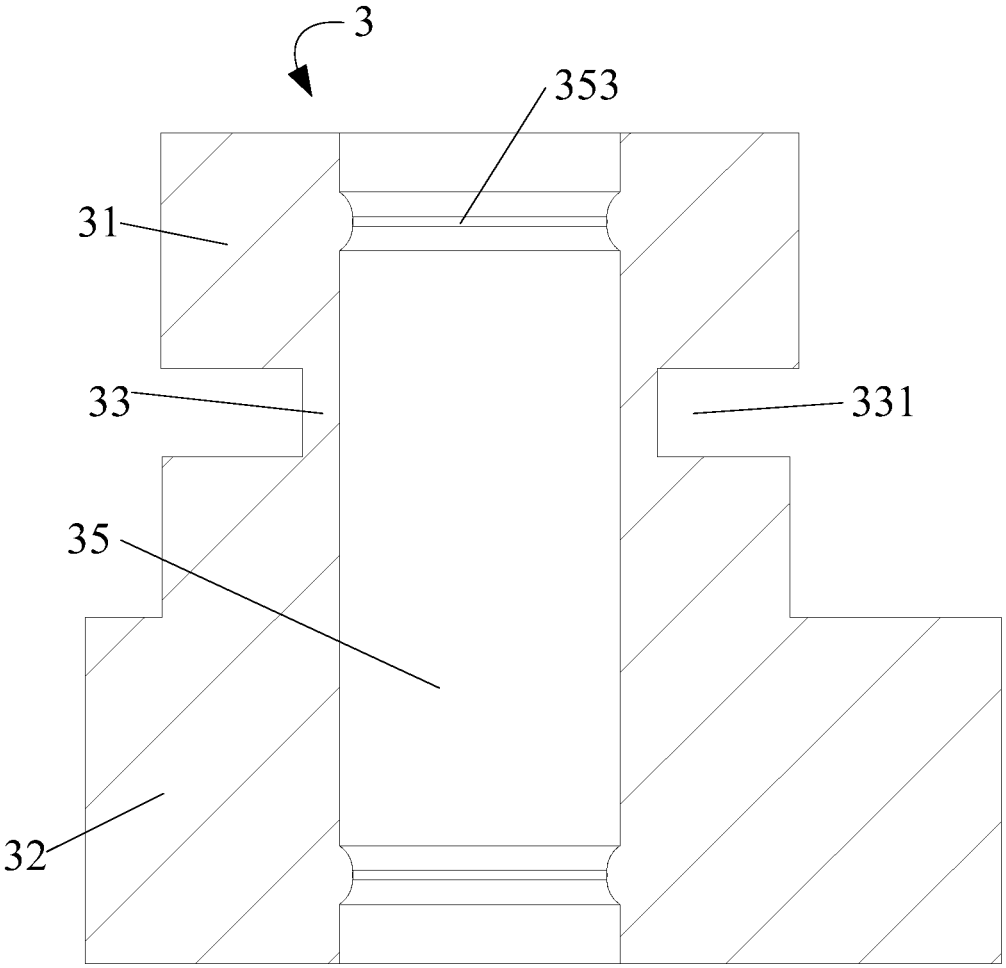
FIG. 9 is a schematic cross-sectional diagram in the A-A direction in FIG. 8.
Figure 10:
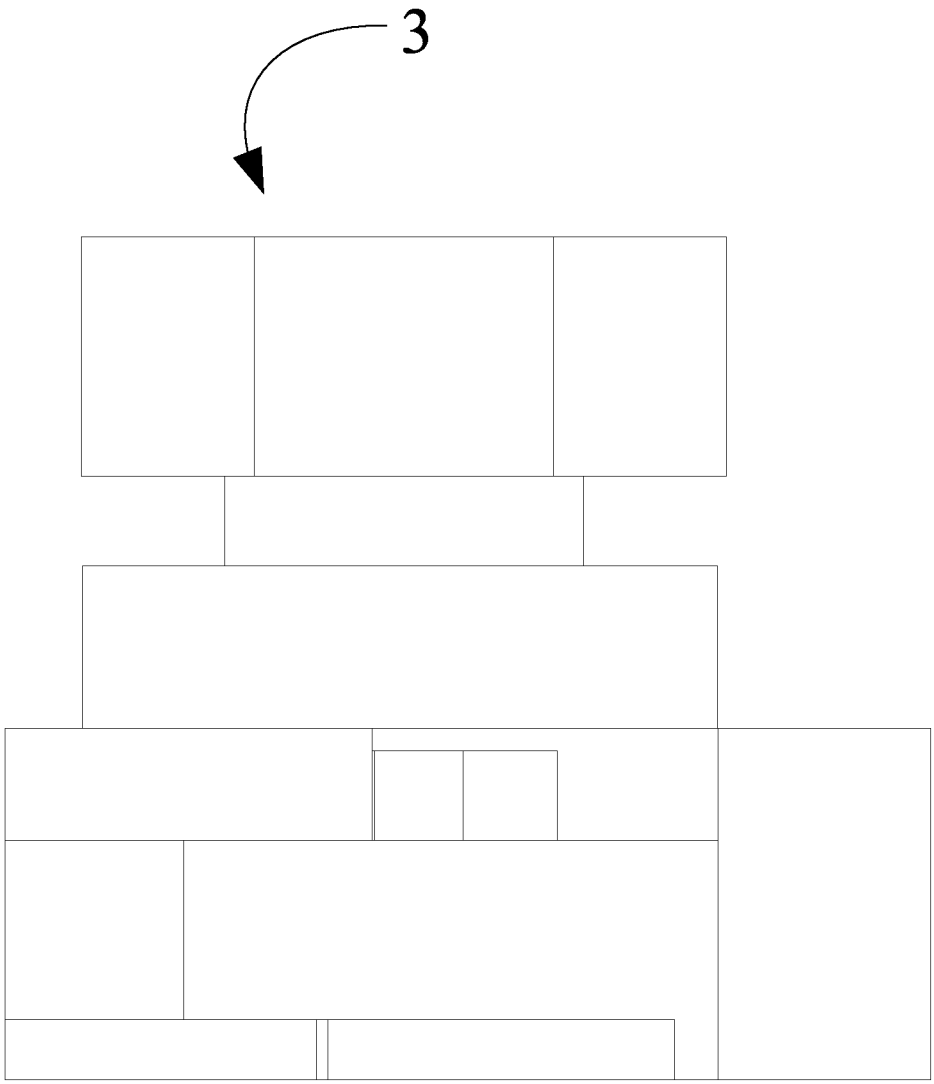
FIG. 10 is a schematic structural diagram of the vibration isolation member described in Embodiment 1 of the present disclosure from a second perspective.
Figure 11:
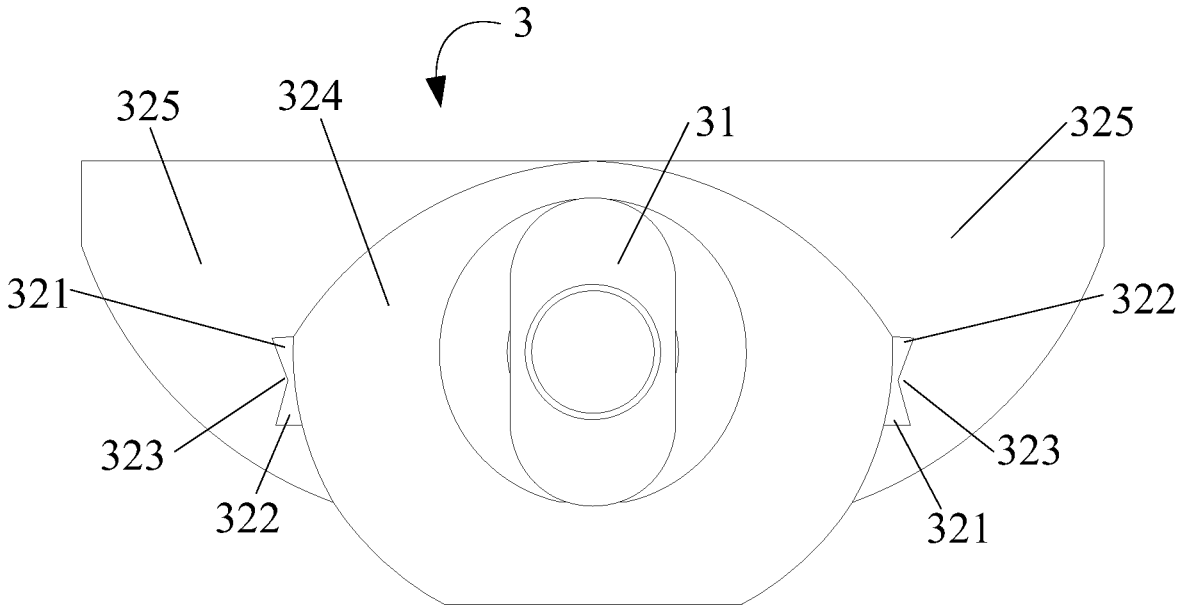
FIG. 11 is a schematic structural diagram of the vibration isolation member described in Embodiment 1 of the present disclosure from a third perspective.
Figure 12:
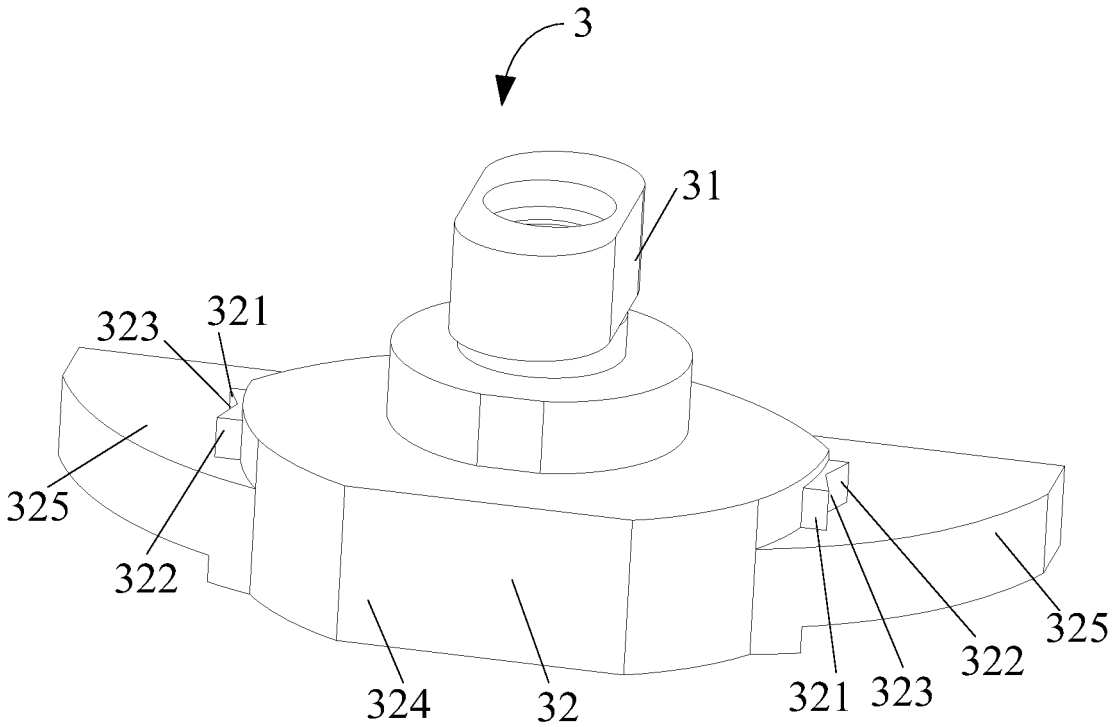
FIG. 12 is a schematic structural diagram of the vibration isolation member described in Embodiment 1 of the present disclosure from a fourth perspective.
Figure 13:
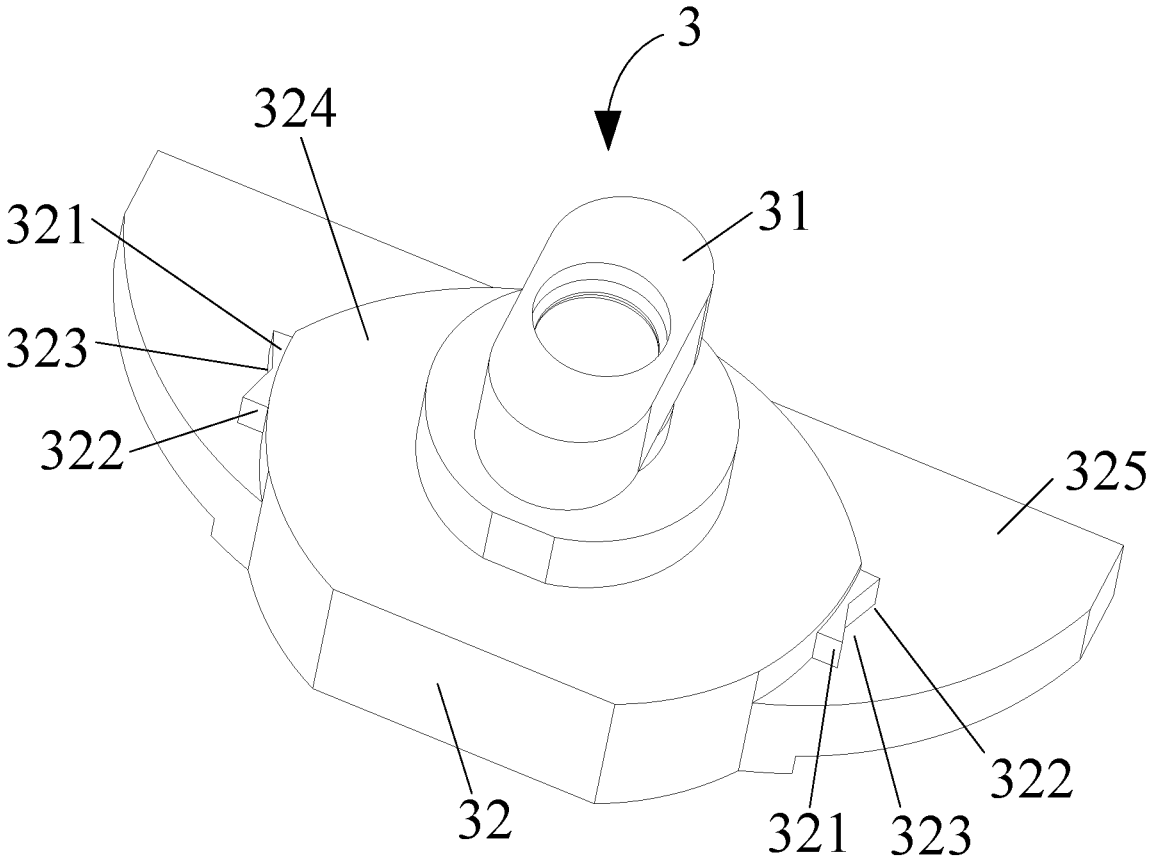
FIG. 13 is a schematic structural diagram of the vibration isolation member described in Embodiment 1 of the present disclosure from a fifth perspective.
Figure 14:
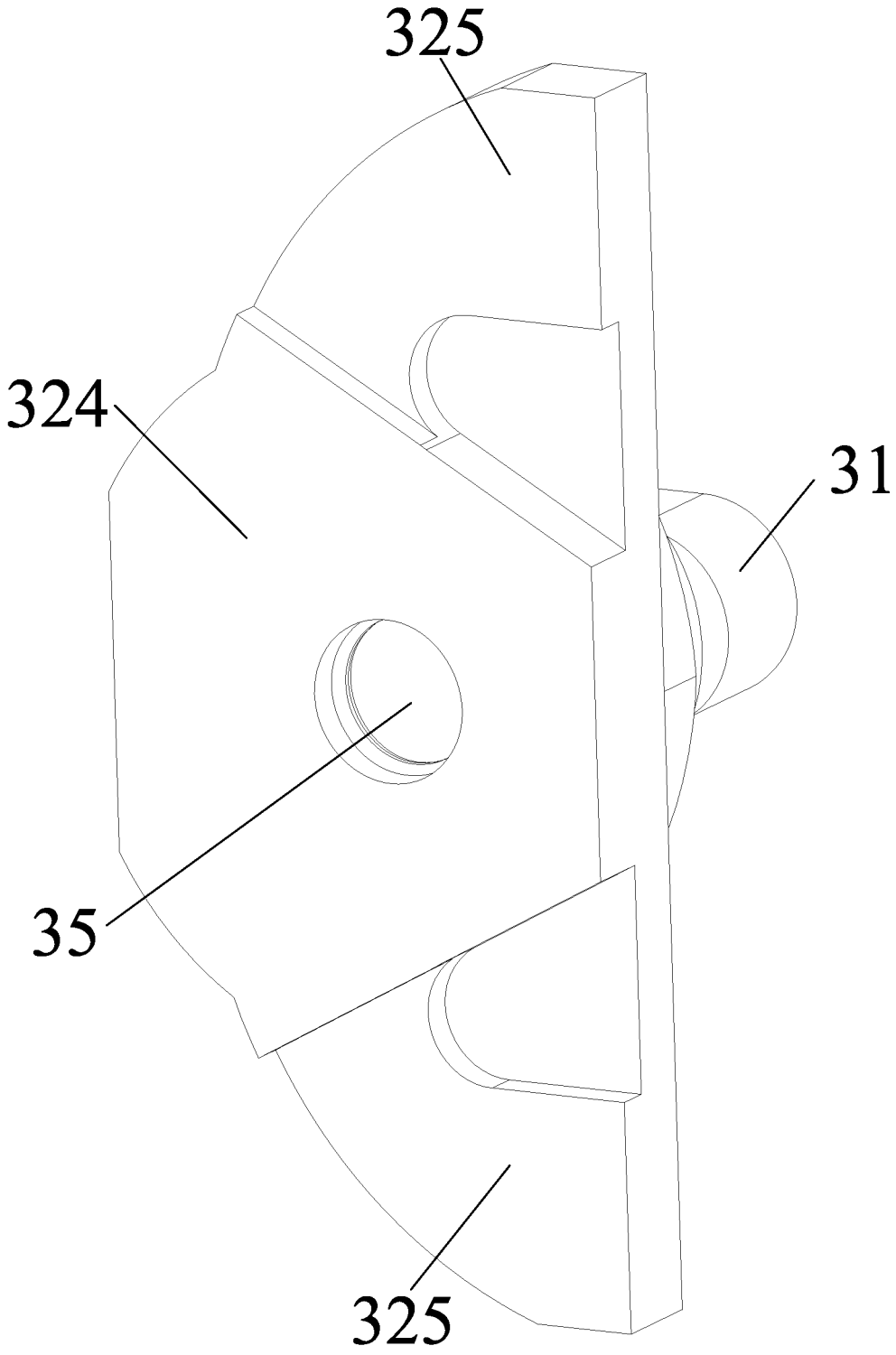
FIG. 14 is a schematic structural diagram of the vibration isolation member described in Embodiment 1 of the present disclosure from a sixth perspective.
Figure 15:
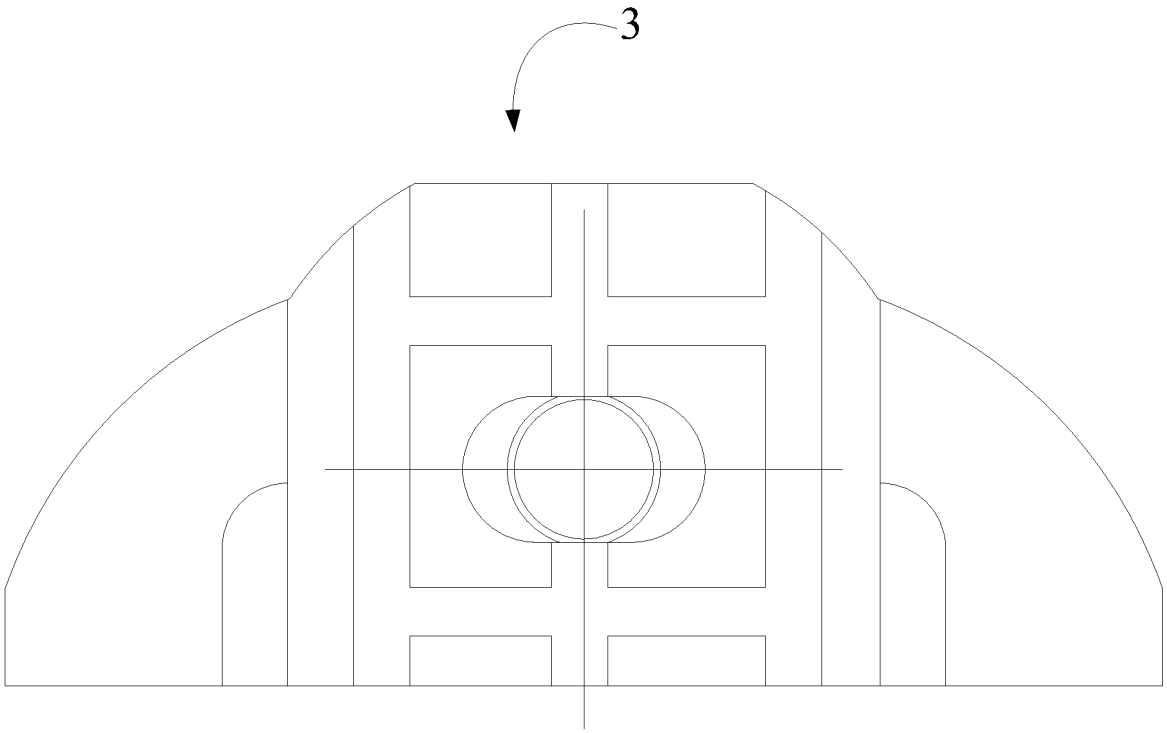
FIG. 15 is a schematic structural diagram of the vibration isolation member described in Embodiment 2 of the present disclosure from a first perspective.
Figure 16:
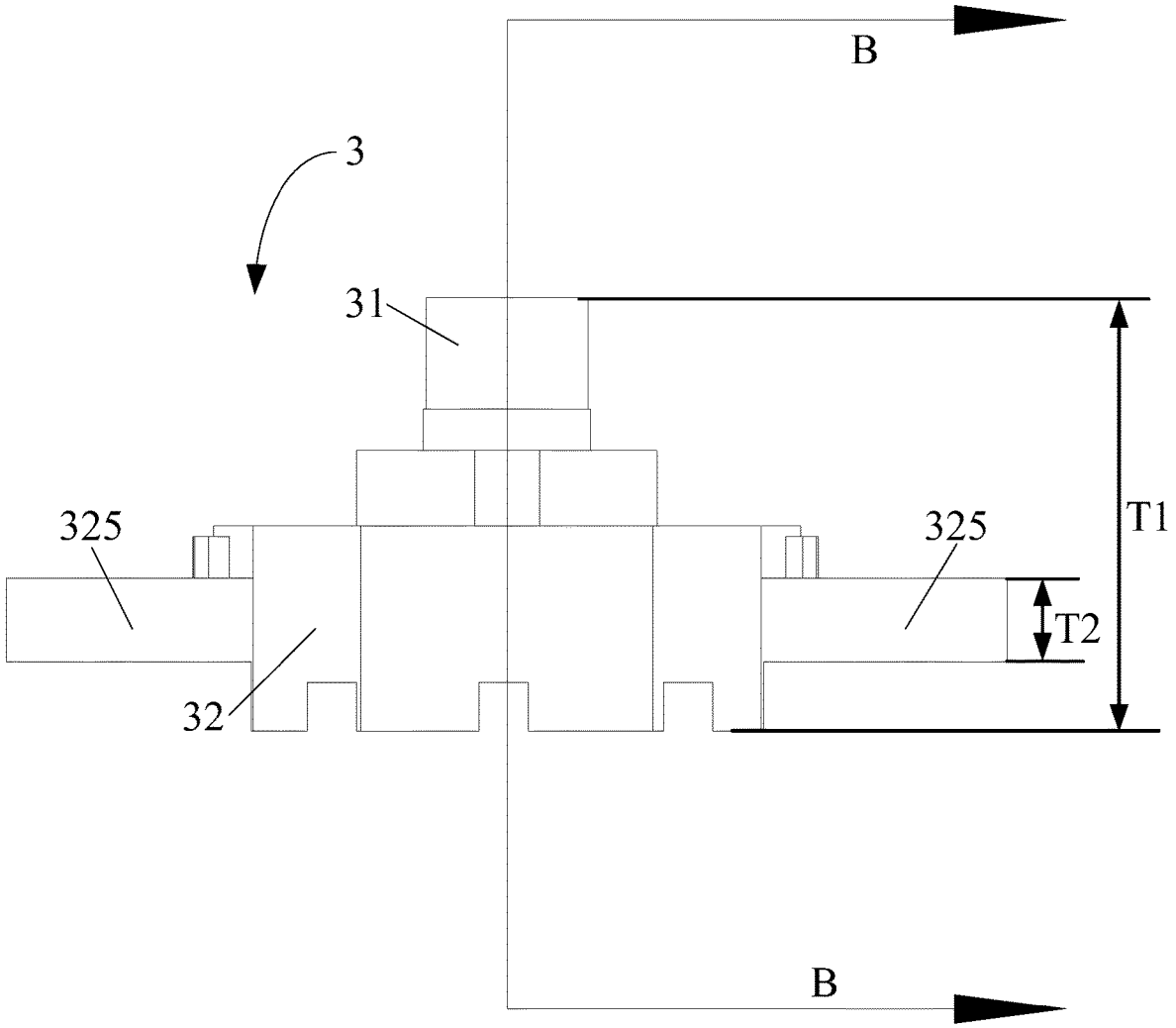
FIG. 16 is a schematic structural diagram from of the vibration isolation member described in Embodiment 2 of the present disclosure from a second perspective.
Figure 17:
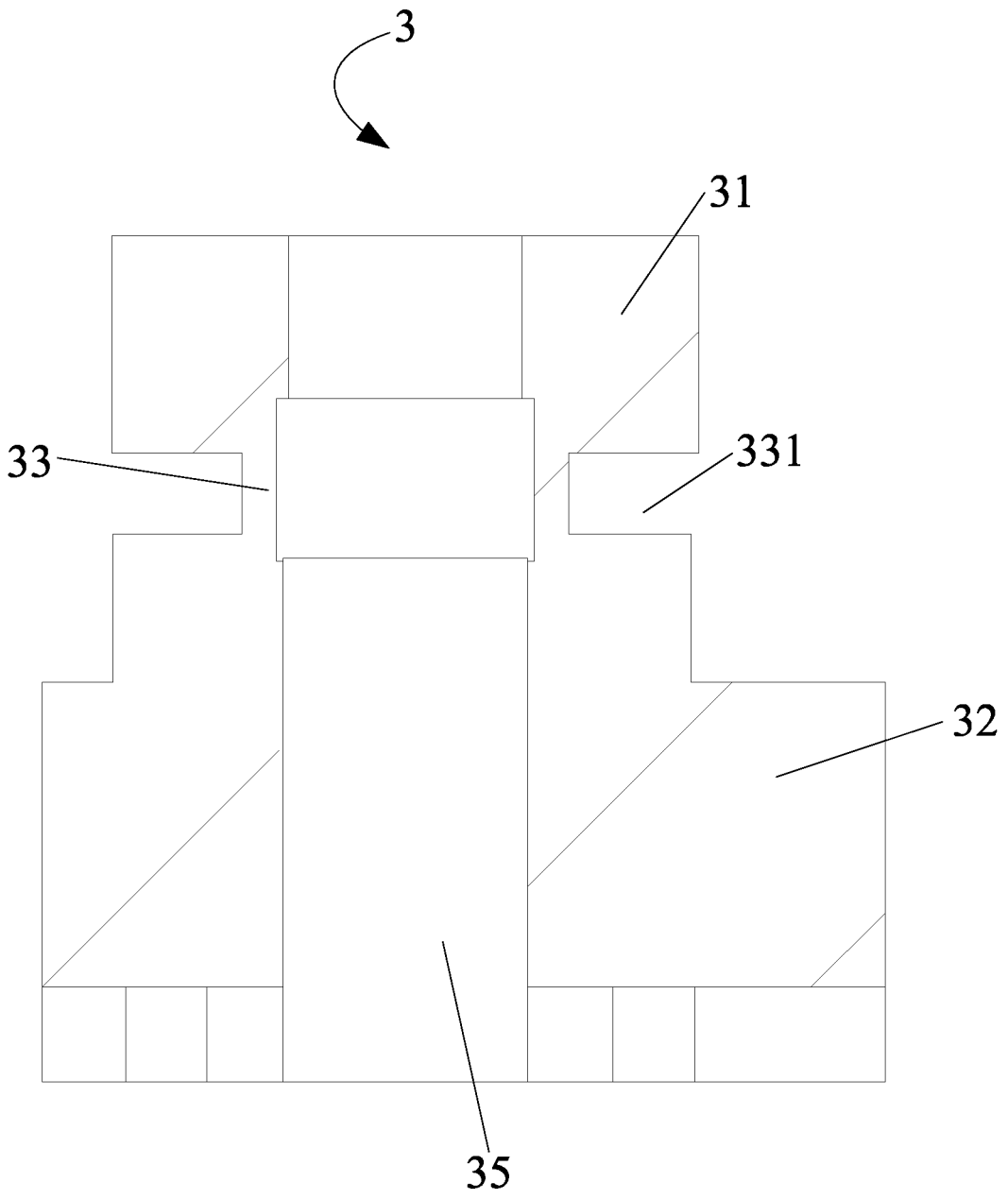
FIG. 17 is a schematic cross-sectional diagram in B-B direction in FIG. 16.
Figure 18:
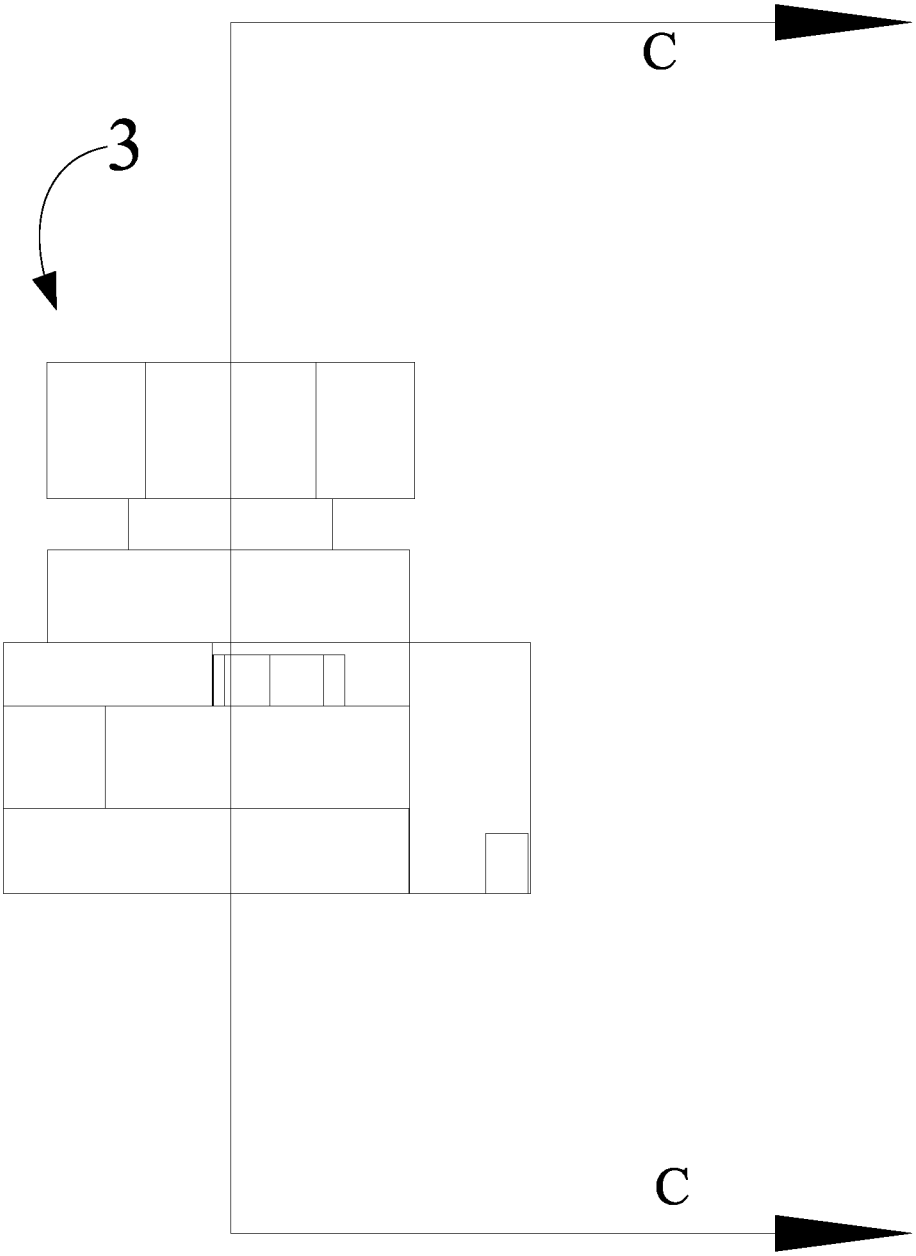
FIG. 18 is a schematic structural diagram of the vibration isolation member described in Embodiment 2 of the present disclosure from a third perspective.
Figure 19:
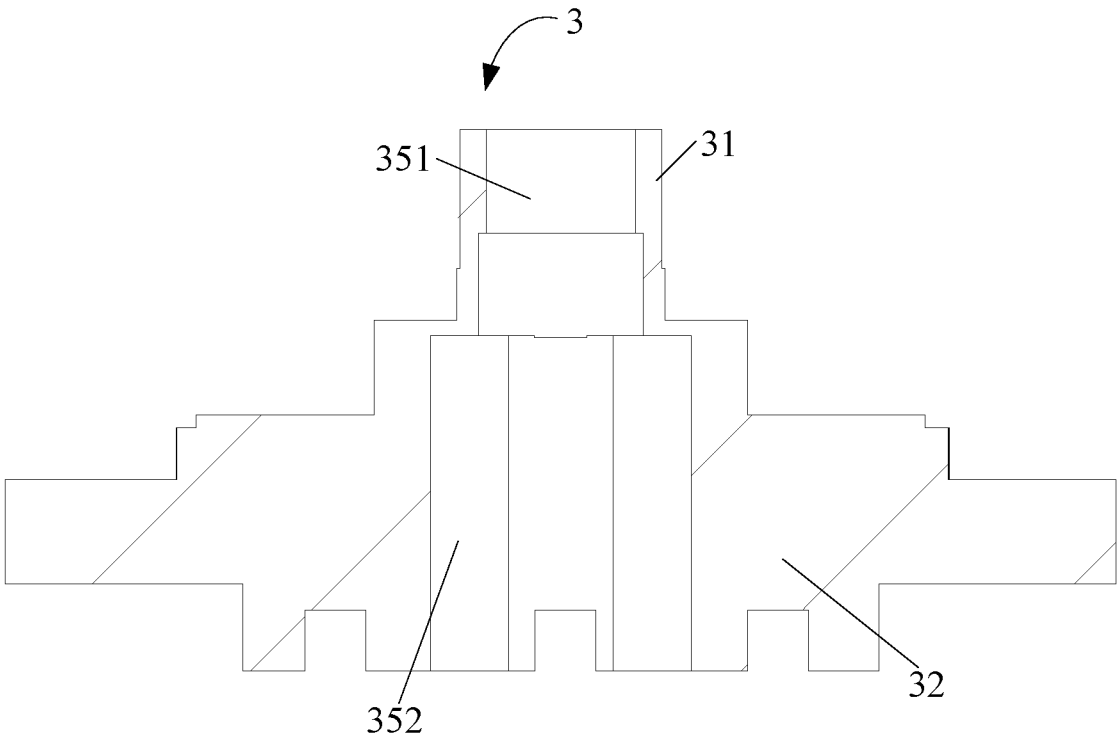
FIG. 19 is a schematic cross-sectional diagram in C-C direction in FIG. 18.
Figure 20:
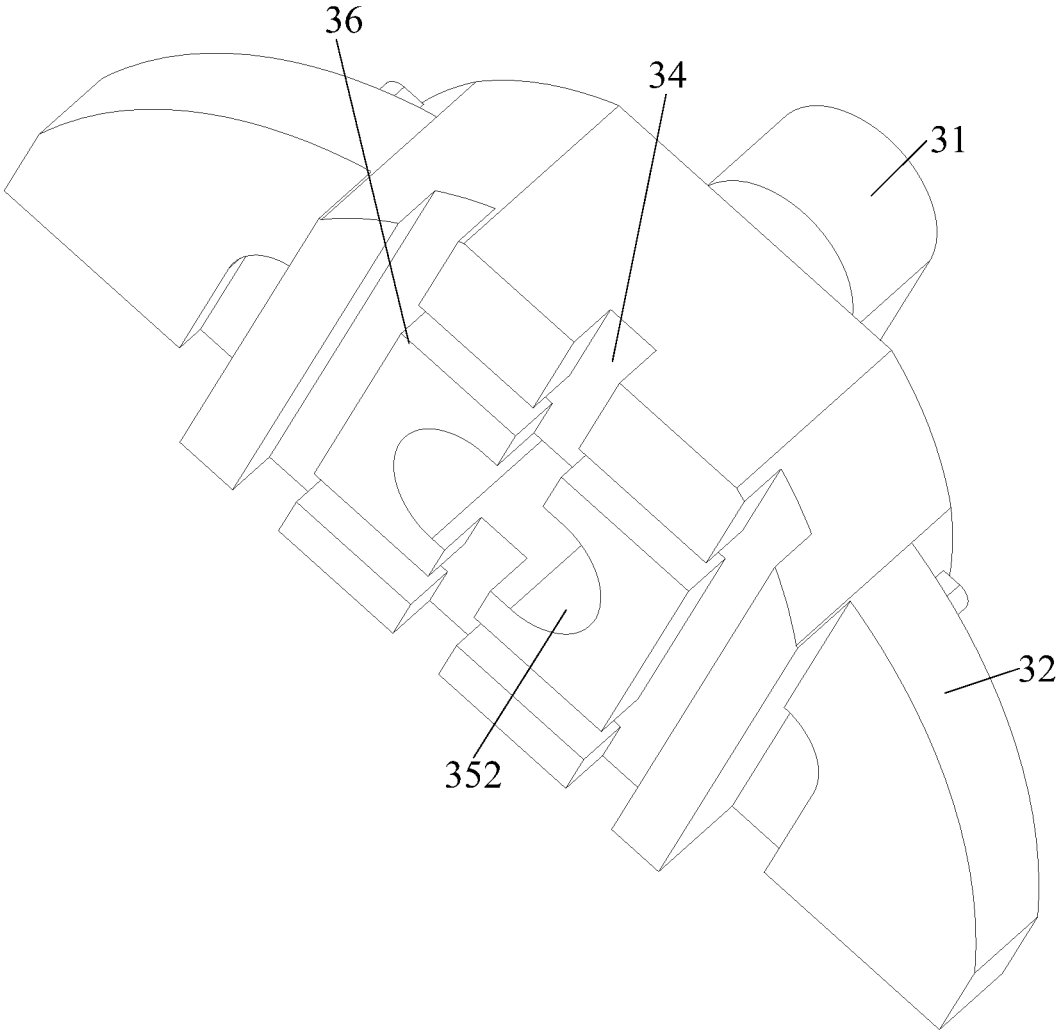
FIG. 20 is a schematic structural diagram of the vibration isolation member described in Embodiment 2 of the present disclosure from a fourth perspective.

The method of installing the isolation structure 10 is as follows: as shown in FIGS. 4 and 5, pass the first end part 31 of the vibration isolation member 3 through the mounting hole 21 of the foot 2, and rotate the vibration isolation member 390 degrees counterclockwise in a direction shown in the figure, to reach the position shown in FIGS. 6 and 7, so that the first end part 31 has a waist-shaped structure, and the long side of the waist-shaped structure is framed on the foot 2. In the process of rotation, when the first limit protrusion 321 of the vibration isolation member 3 passes the limit edge of the foot 2 (the limit edge is the hole wall of the avoidance hole), the limit edge will feedback greater resistance, when the limit position is reached, the limit edge does not feedback resistance, and there is obvious hand feeling feedback at this time, and the rotation in place can be sensed. The existence of the limit structure prevents the vibration isolation member 3 from rotating freely around the axis of the connection hole 35. The method of the first end part 31 and the second end part 32 clamping the foot 2 can avoid the vibration isolation member 3 from moving up and down.

The main elastic bearing structure is concentrated on the second end part 32 and the thickest part of the second end part 32 (that is, the main body 324). In the structure of the vibration isolation member 3, the material of the side edge 325 at the bottom is thinned, to avoid that after it is deformed due to the load, the vibration of the foot 2 is transmitted to the installation foundation through the side edge 325, resulting in a relatively weakened vibration isolation effect, which can ensure the best vibration isolation effect.

Furthermore, the bottom of the vibration isolation member 3 is provided with a second hole section 352 which can accommodate the misalignment between the foot pad and the installation foundation. The size of the second hole section 352 is larger than the upper first hole section 351 in the left and right direction. It can be a waist-shaped hole, a rectangular hole, a large round hole, a square hole, etc. When the upper first hole section 351 is staggered with the assembly hole of the installation foundation, the mounting bolts can also pass through the lower hole section (the waist-shaped hole in the attached figure), which provides convenience for installation. And a vibration isolation groove 34 is opened at the bottom of the second end part 32 to further improve the vibration isolation ability.

The volume of the vibration isolation member 3 of this embodiment is only 18 cubic centimeters, and the volume of the vibration isolation member 3 of the conventional structure is about 3 times that of this structure. Therefore, the vibration isolation member 3 in the present disclosure can effectively reduce the material consumption of the vibration isolation member 3.

The vibration isolation member 3 is provided with a rigidity weakening hole to reduce the rigidity of the vibration isolation member 3. Specifically, the rigidity weakening hole can reduce the amount of material used in the vibration isolation member, thereby reducing the rigidity of the vibration isolation member 3, and further reducing the transmission of the vibration of the outdoor device to the installation foundation. Under the premise of ensuring the using strength of the vibration isolation member, in practical applications, the shape, size, number and position of the rigidity weakening hole can be flexibly set.

At least one of the first end part 31 and the second end part 32 is provided with a vibration isolation groove 34, thereby forming a vibration damping rib 36, to further improve the vibration isolation ability. The vibration isolation groove 34 can be in multiple directions, such as a vertical and horizontal vibration isolation groove 34. In one embodiment, the lower end of the second end part 32 is provided with a vibration isolation groove 34.

In this embodiment, the vibration isolation member 3 can be stuck on the mounting hole 21 of the foot 2 through the first end part 31 and the second end part 32, and the first end part 31 or the second end part 32 can pass through the mounting hole 21. After the first end part 31 or the second end part 32 passes through the mounting hole 21, it can be rotated to ensure that the vibration isolation member 3 is constrained on the foot 2. The vibration isolation member 3 is provided with a rotation limit member. After the rotation is in place, the hand feel has obvious changes, and users can judge whether the rotation is in place. The vibration isolation member 3 is provided with a connection hole 35, which is used to pass the mounting bolt, and the connection hole 35 is provided with a positioning member, to avoid too much deviation between the center of the mounting bolt and the center of the connection hole 35. The material of vibration isolation member 3 is not limited, and it can be elastomers such as rubber or foam. In vibration isolation member 3, some rigidity weakening grooves, rigidity weakening holes and other structural measures to reduce the rigidity of vibration isolation member 3 can be set. The material of the vibration isolation member 3 is not limited, and it can be an elastomer such as rubber or foam. The vibration isolation member 3 can set some rigidity weakening grooves, rigidity weakening holes and other structural measures to reduce the rigidity of the vibration isolation member 3.

Therefore, the isolation structure 10 of the embodiment can effectively isolate and attenuate the transmission of outdoor device vibration to the installation foundation, and eliminate the wall resonance noise. In addition, the vibration isolation member 3 is very easy to install, it can be firmly fixed at the outdoor device foot 2 without falling off or shifting, and the vibration isolation member 3 is small in size and low in cost, about ⅓ of the conventional vibration isolation member 3.

In one embodiment, in the embodiment, the vibration isolation member cannot move relative to the foot in a direction that deviates from the axis of the connection hole (such as left and right or up and down directions). It can be understood that the vibration isolation member can also move relative to the foot in a direction that deviates from the axis of the connection hole (for example, the left and right direction or the up and down direction).

Embodiment 2

The difference from Embodiment 1 is that the second end part 32 is suitable to be installed between the foot 2 and the installation foundation. The foot 2 is provided with an avoidance member for avoiding the second end part 32 or the second end part 32 is provided with an avoidance member for avoiding the foot 2, so that the second end part 32 and the foot 2 can deviate from the axis of the mounting hole 21 and move relative to each other.

The avoidance member can be an avoidance hole or an avoidance gap. After setting the avoidance member, the second end part 32 can move relative to the foot 2 in the direction deviating from the axis of the mounting hole 21 or the axis of the connection hole 35. For example, the second end part 32 can be moved left and right or back and forth relative to the foot 2, to solve the alignment problem between the connection hole 35 of the vibration isolation member 3 and the assembly hole of the installation foundation during installation, so that the connection hole 35 and the assembly hole are easier to align, thereby improving the previous assembly efficiency of the foot 2, the vibration isolation member 3 and the installation foundation.

Exemplary: The rotation limit member in Embodiment 1 can be cancelled, and an avoidance member is set on the second end part 32 or the foot 2, to realize the overall left and right movement of the vibration isolation member 3, and solve the alignment problem between the connection hole 35 of the vibration isolation member 3 and the assembly hole of the installation foundation during installation.

The embodiments of the second aspect of the present disclosure provide an air conditioner outdoor device, which includes an outdoor device main body, and also includes the air conditioner outdoor device isolation structure 10 of any one of the embodiments of the first aspect, and the foot 2 of the isolation structure 10 is connected to the outdoor device main body.

The air conditioner outdoor device provided by the embodiments of the second aspect of the present disclosure includes the isolation structure 10 described in any one of the embodiments of the first aspect, and therefore it has all the beneficial effects of the isolation structure 10 described in any one of the embodiments of the first aspect, which will not be repeated here.

In one embodiment, the outdoor device main body includes a chassis 1, and the foot 2 is connected to the chassis 1. For example, the foot 2 is welded to the chassis 1. The number of the foot 2 is multiple, for example, the number of the foot 2 is 2.

The embodiments of the third aspect of the present disclosure provide an air conditioner, which includes an indoor device, and further includes the air conditioner outdoor device as described in the above-mentioned embodiment and the air conditioner outdoor device is connected to the indoor device.

The air conditioner provided by the embodiments of the third aspect of the present disclosure includes the air conditioner outdoor device described in the embodiments of the second aspect, and therefore it has all the beneficial effects of the air conditioner outdoor device described in the embodiments of the second aspect, which will not be repeated here.

In summary, as shown in FIGS. 1 to 20, the isolation structure 10 of the outdoor device provided by the embodiments of the present disclosure can effectively isolate the transmission of the vibration of the outdoor device to the installation foundation. In addition, the vibration isolation member 3 uses less material and has low cost; the vibration isolation member 3 and the outdoor device foot 2 cooperate firmly, making installation convenient and user-friendly.

In the description of the present disclosure, the term "plurality" refers to two or more than two, unless clearly defined otherwise. The terms "connected," "mounted" and the like are to be construed broadly, and for example, the term "connected" may refer to a fixed connection, a flexible connection, or an integral connection, or an electrical connection; it may refer to a direct connection or an indirect connection through an intermediary. The specific meaning of the above terms in the present disclosure will be understood by those of ordinary skill in the art, as the case may be.

In the description of the present disclosure, it should be understood that the directions or positional relationships indicated by the terms "upper," "lower," "front," "rear," "left," "right," etc. are based on the directions or positional relationships shown in the drawings, and are merely intended to facilitate and simplify the description rather than to indicate or imply that the apparatus or unit referred to must have a particular direction or be constructed and operated in a particular orientation. Therefore, the above terms are not to be construed as limiting the invention.

In the description of the present specification, the descriptions of the terms "one embodiment," "some embodiments" and "specific embodiments" and the like mean that specific features, structures, materials or characteristics described in conjunction with the embodiment(s) or example(s) are included in at least one embodiment or example of the present disclosure. In the specification, the schematic representation of the above terms does not necessarily refer to the same embodiment or example. Moreover, the particular features, structures, materials or characteristics described may be combined in a suitable manner in any one or more embodiments or examples.

The descriptions above are only preferred embodiments of the present disclosure, which are not used to limit the present disclosure. For a person skilled in the art, the present disclosure may have various changes and variations. Any modifications, equivalent substitutions, improvements etc. within the spirit and principle of the present disclosure shall all be included in the protection scope of the present disclosure.

What is claimed is:

1. An air conditioner outdoor device isolation structure comprising:

a foot including a mounting hole; and a vibration isolation member including:

a first end part, a connection part, and a second end part connected in sequence; and a connection hole penetrating the first end part, the connection part, and the second end part;

wherein:

the connection part is located in the mounting hole and includes a positioning groove located in the mounting hole; and the first end part and the second end part are located on opposite sides of the mounting hole.

2. The isolation structure according to claim 1, wherein:

the connection hole is configured to cooperate with a fastener; and a positioning member is provided in the connection hole, for positioning between the fastener and the connection hole.

3. The isolation structure according to claim 2, wherein:

the positioning member includes a positioning protrusion protruding from an inner wall of the connection hole in a direction towards an axis of the connection hole.

4. The isolation structure according to claim 1, wherein:

the second end part is configured to be arranged between the foot and an installation foundation;

the connection hole includes a first hole section and a second hole section that are in communication with each other and arranged in sequence along a direction from the first end part to the second end part;

the second hole section penetrates an end surface of the second end part away from the first end part; and an opening size of the second hole section is larger than an opening size of the first hole section.

5. The isolation structure according to claim 1, further comprising:

an avoidance member configured to allow the vibration isolation member and the foot to deviate from an axis of the mounting hole and move relative to each other, the avoidance member being:

provided at the foot and configured to avoid the vibration isolation member; or provided at the vibration isolation member and configured to avoid the foot.

6. The isolation structure according to claim 1, further comprising:

a rotation limit member at the vibration isolation member.

7. The isolation structure according to claim 6, wherein:

the rotation limit member includes a limit protrusion at the vibration isolation member.

8. The isolation structure according to claim 7, wherein:

the limit protrusion is a first limit protrusion;

the rotation limit member further includes a second limit protrusion at the vibration isolation member; and a limit groove is formed between the second limit protrusion and the first limit protrusion.

9. The isolation structure according to claim 6, wherein:

the foot further includes a receiving hole;

the second end part is at least partially located in the receiving hole; and the rotation limit member is arranged at the second end part.

10. The isolation structure according to claim 1, wherein:

the second end part includes a main body and a side edge connected to a side of the main body;

the connection hole penetrates the main body; and a thickness of the main body is greater than a thickness of the side edge.

11. The isolation structure according to claim 1, wherein:

the mounting hole is non-circular; and the first end part is configured to pass through the mounting hole and to interfere with the mounting hole in a direction from the first end part to the second end part after the first end part and the mounting hole rotate relative to each other by a predetermined angle.

12. The isolation structure according to claim 1, wherein:

the mounting hole is non-circular; and the second end part is configured to pass through the mounting hole and to interfere with the mounting hole in a direction from the second end part to the first end part after the second end part and the mounting hole rotate relative to each other by a predetermined angle.

13. The isolation structure according to claim 1, wherein:

the vibration isolation member includes at least one of a rubber vibration isolation member, a silicone vibration isolation member, or a foam vibration isolation member.

14. The isolation structure according to claim 1, wherein:

at least one of the first end part or the second end part is provided with a vibration isolation groove.

15. An air conditioner outdoor device comprising:

an outdoor device main body; and an isolation structure including:

a foot connected to the outdoor device main body and including a mounting hole; and a vibration isolation member including:

a first end part, a connection part, and a second end part connected in sequence; and a connection hole penetrating the first end part, the connection part, and the second end part;

wherein:

the connection part is located in the mounting hole and includes a positioning groove located in the mounting hole; and the first end part and the second end part are located on opposite sides of the mounting hole.

16. An air conditioner outdoor device isolation structure comprising:

a foot including a mounting hole; and a vibration isolation member including:

a first end part, a connection part, and a second end part connected in sequence; and a connection hole penetrating the first end part, the connection part, and the second end part;

wherein:

the connection part is located in the mounting hole;

the first end part and the second end part are located on opposite sides of the mounting hole; and at least one of the first end part or the second end part is provided with a vibration isolation groove.

* * * * *